US007478580B1

(12) United States Patent
Parimi et al.

(10) Patent No.: US 7,478,580 B1
(45) Date of Patent: Jan. 20, 2009

(54) SCULPTED TRANSPARENT ARMOR

(75) Inventors: Sanjay Parimi, Chester, NJ (US); Thomas Kiel, Bernardsville, NJ (US); Anthony Cautero, Hackettstown, NJ (US); Antonio D. Ralph, Dover, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 228 days.

(21) Appl. No.: 11/612,064

(22) Filed: Dec. 18, 2006

Related U.S. Application Data

(60) Provisional application No. 60/597,793, filed on Dec. 20, 2005.

(51) Int. Cl.
*F41H 5/20* (2006.01)
*F41H 7/02* (2006.01)

(52) U.S. Cl. ..... 89/36.13; 89/36.07; 89/36.08

(58) Field of Classification Search ..... 89/36.07, 89/36.08, 36.11, 36.12, 36.13, 36.14
See application file for complete search history.

(56) References Cited

U.S. PATENT DOCUMENTS

| | | | | | |
|---|---|---|---|---|---|
| 2,358,257 | A * | 9/1944 | Schwab | ..... | 89/36.03 |
| 2,392,106 | A * | 1/1946 | Sutton | ..... | 89/36.11 |
| 2,454,268 | A * | 11/1948 | Brackett | ..... | 89/36.14 |
| 3,581,621 | A * | 6/1971 | Bauer | ..... | 89/36.14 |
| 3,710,681 | A * | 1/1973 | Koontz | ..... | 89/36.14 |
| 3,757,635 | A * | 9/1973 | Hickerson et al. | ..... | 89/36.08 |
| 4,004,494 | A * | 1/1977 | Mechulam et al. | ..... | 89/36.14 |
| 4,062,267 | A * | 12/1977 | Vinches et al. | ..... | 89/41.19 |
| 4,101,896 | A * | 7/1978 | Ikrath et al. | ..... | 343/713 |
| 4,577,546 | A * | 3/1986 | Jackson | ..... | 89/41.19 |
| 4,583,444 | A * | 4/1986 | Jackson | ..... | 89/36.13 |
| 6,327,954 | B1 * | 12/2001 | Medlin | ..... | 89/36.08 |
| 2004/0226231 | A1 * | 11/2004 | Dlubak | ..... | 52/204.1 |
| 2005/0188831 | A1 * | 9/2005 | Squires et al. | ..... | 89/36.02 |
| 2005/0238880 | A1 * | 10/2005 | Labock | ..... | 428/412 |
| 2005/0252367 | A1 * | 11/2005 | Jilg et al. | ..... | 89/36.14 |
| 2007/0000377 | A1 * | 1/2007 | Ohnstad | ..... | 89/36.13 |

* cited by examiner

*Primary Examiner*—Michael Carone
*Assistant Examiner*—Michael D David
(74) *Attorney, Agent, or Firm*—John F. Moran

(57) ABSTRACT

A gunner protection apparatus for a tactical or armored vehicle having a turret or hatch opening that exposes crewmembers to enemy threats. The gunner protection apparatus includes a turret portion attached to the vehicle's turret, the turret portion comprising a substantially circular base plate fixed to the vehicle's turret; a plurality of vertical supports fixed to the base plate; a plurality of clamps connected to the plurality of vertical supports, respectively; and a plurality of curved glass panels having ends fixed between the clamps and the vertical supports; a gun support disposed in a bearing sleeve hole and rotatable about a vertical axis of the bearing sleeve hole; and a front shield fixed to the gun support, the front shield having a gun opening and at least one window, the front shield being rotatable with the gun support.

16 Claims, 8 Drawing Sheets

SCULPTED TRANSPARENT ARMOR

CROSS-REFERENCE TO RELATED APPLICATIONS

This application claims the benefit under 35 USC 119(e) of U.S. provisional patent application No. 60/597,793 filed on Dec. 20, 2005, which application is hereby incorporated by reference.

STATEMENT OF GOVERNMENT INTEREST

The inventions described herein may be manufactured, used and licensed by or for the U.S. Government for U.S. Government purposes.

BACKGROUND OF THE INVENTION

The invention relates in general to protective armor and in particular to protection for top gunners in tactical vehicles and armored vehicles.

Armies have utilized metal and ceramic armor to protect troops from incident projectiles and explosive fragments. Soldiers situated behind these types of armor, however, have little visibility and are thus unable to locate threats, leaving them exposed to further attack. Viewing the battlefield is currently done by rising above the armor, engaging the enemy while above the armor, and then dropping down when fired upon. This method leaves the soldier exposed while engaging the enemy and does not lend itself to giving him both protection and battlefield awareness.

Traditional ballistic windows are used to mitigate lack of visibility, but no arrangement has been devised that provides high visibility and overall armor protection, without compromising the structural integrity of the armor system. Commonly used "flat" ballistic windows are fitted into traditional armor packages to help increase visibility. This solution suffers from the tradeoff of reducing protection while providing only a small increase in visibility. Providing a soldier with a full 360 degrees of visibility would dramatically increase his ability to rapidly identify and engage targets on the battlefield.

SUMMARY OF THE INVENTION

It is an object of the invention to provide a gunner protection apparatus that provides a field of view of substantially 360 degrees, without degradation to ballistic performance or structural integrity.

It is another object of the invention is to provide a modular gunner protection apparatus wherein damaged components may be replaced without replacing the complete apparatus.

One aspect of the invention is a gunner protection apparatus for a vehicle having a turret with a bearing sleeve hole, the apparatus comprising a turret portion attached to the vehicle's turret, the turret portion comprising a substantially circular base plate fixed to the vehicle's turret; a plurality of vertical supports fixed to the base plate; a plurality of clamps connected to the plurality of vertical supports, respectively; and a plurality of curved glass panels having ends fixed between the clamps and the vertical supports; a gun support disposed in the bearing sleeve hole and rotatable about a vertical axis of the bearing sleeve hole; and a front shield fixed to the gun support, the front shield having a gun opening and at least one window, the front shield being rotatable with the gun support.

A plurality of gussets are fixed between the vertical supports and the base plate. Top rails are disposed along top edges of the glass panels. Ribs are disposed along interior, bottom edges of the glass panels.

The turret portion defines an opening having an angular extent in the range of about 30 degrees to about 40 degrees. A width of the opening in the turret portion is less than a width of the front shield. The opening in the turret portion is substantially centered around the bearing sleeve hole.

The gun support comprises a bearing sleeve having a portion inserted in the bearing sleeve hole and a pintle having a portion inserted in the bearing sleeve. A front spacer is fixed to the pintle, the front shield being attached to the front spacer. The front shield preferably includes a window on each side of the gun opening.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

An example of a tactical vehicle is a Humvee. Tactical vehicles may have a weapon mounted on their top surface, which is operated by a gunner who is positioned within a turret ring located at the roof of the vehicle. Examples of such weapons are a .50 caliber machine gun and a grenade launcher. The top surface typically has a rotating turret thereon. An opening inside the turret is secured with a hatch. A gunner who is inside the tactical vehicle opens the hatch to operate the weapon. The present invention is an apparatus for protecting the person operating the weapon.

The invention is named Sculpted Transparent Armor (STA). The STA comprises two main components: a turret portion and a front shield. The turret portion and the front shield combine to give high levels of protection and visibility to a vehicle gunner. The STA utilizes formed ballistic glass that can defend against a variety of threats, including IED blasts and projectiles, depending upon the thickness of the glass laminate used. An important feature of the STA is its ability to not only protect a gunner from enemy fire, but at the same time allow the gunner substantially 360 degrees of visibility. Current armor technology does not both protect a gunner and allow substantially 360 degrees of visibility. Thus, the STA is a better solution to the problem.

The STA turret portion utilizes a plurality of curved glass panels. The front shield uses planar pieces of glass. In both cases, the formed ballistic glass is fixed to a metal sub-skeleton that itself is armor. The ballistic glass comprises multiple layers of glass and polycarbonate at varying thicknesses. The glass functions as a hard surface to negate the piercing force of an incoming projectile, while the polycarbonate functions to absorb the blunt pressure and the ballistic energy. Combining the ballistic glass with a metal frame results in good ballistic performance through absorption and deflection of incident projectiles. The metal frame may comprise, for example, steel, aluminum or titanium. The metal frame may be configured differently according to the geometry of the vehicle turret system that supports the STA.

Figure 1:
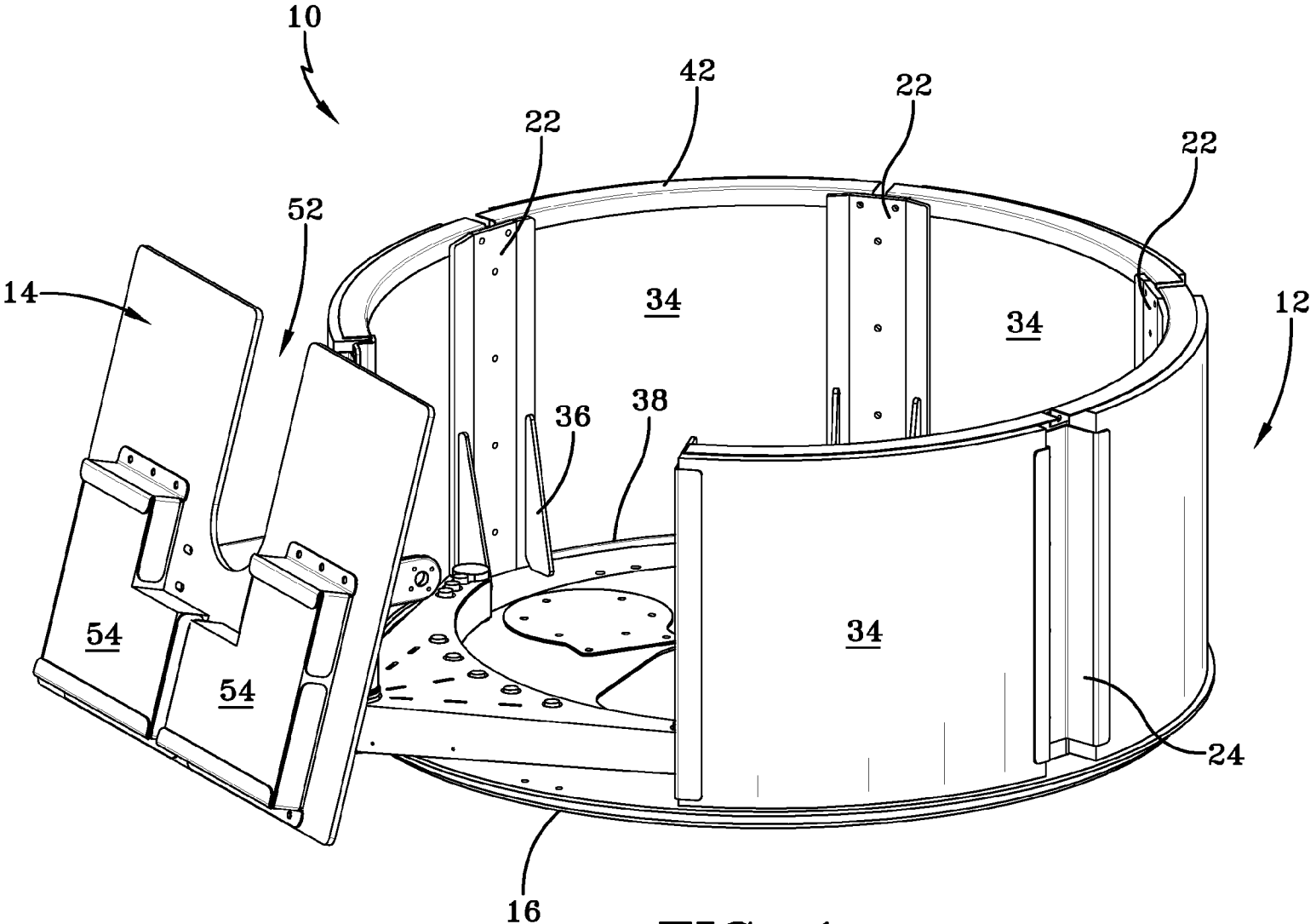
FIG. 1 is a perspective view of one embodiment of the invention.
Figure 2:
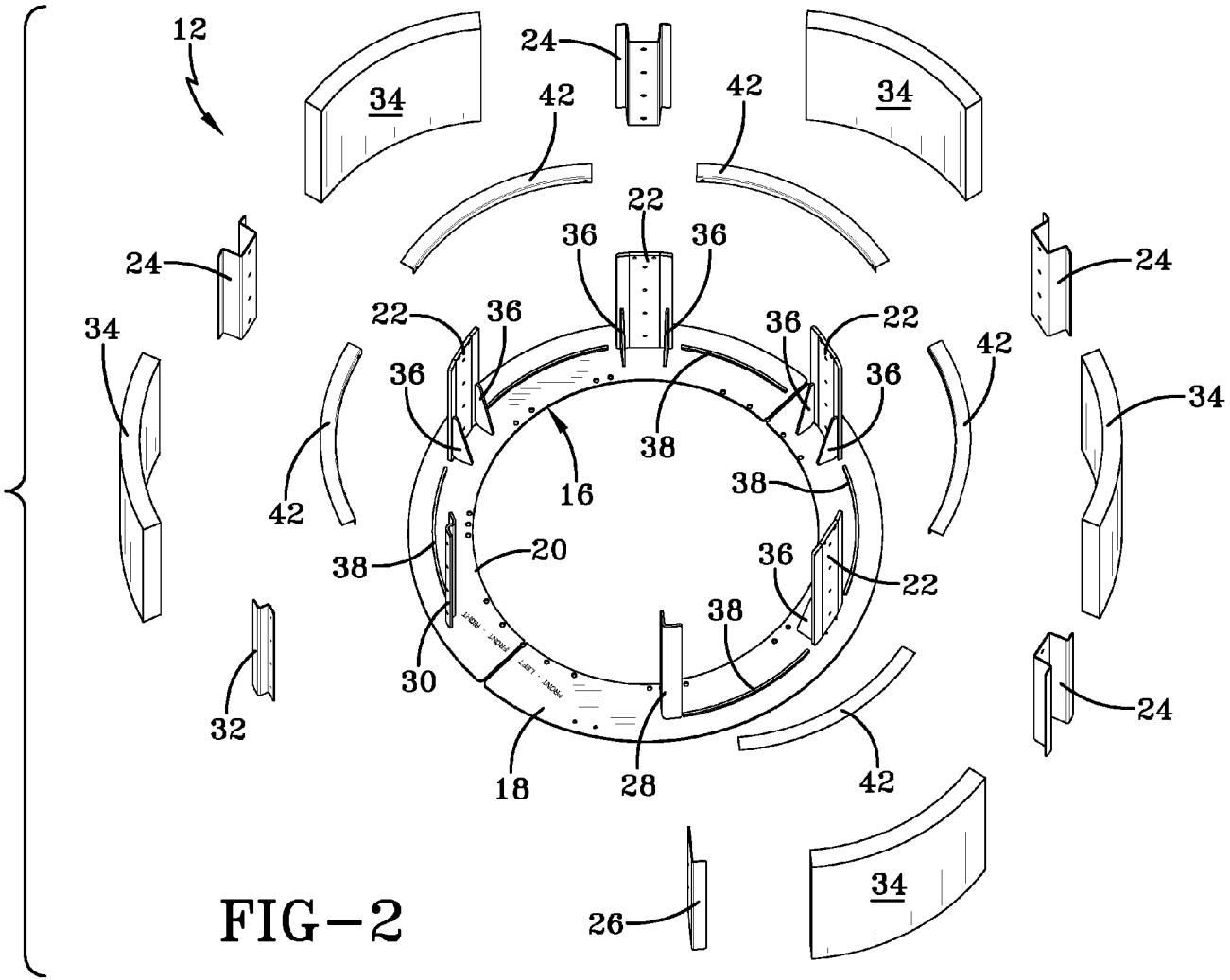
FIG. 2 is an exploded view of the turret portion of the embodiment of FIG. 1.

FIG. 1 is a perspective view of one embodiment of an STA 10 in accordance with the invention. FIG. 2 is an exploded view of the turret portion 12. The STA 10 includes a turret portion 12 and a front shield 14. The STA 10 is mounted on the turret of a vehicle (not shown). The turret portion 12 includes a substantially circular base plate 16 fixed to the vehicle's turret with, for example, threaded fasteners. Base plate 16 may comprise two substantially semi-circular base plates 18, 20 (FIG. 2). In one embodiment, the fastening holes in the base plate 16 mimic the existing hole patterns of the vehicle's turret ring, for a simple bolt-on assembly.

As shown in FIG. 2, a plurality of vertical supports 22, 28, 30 are fixed to the base plate 16 using, for example, welded connections. The vertical supports 22, 28, 30 support the inner radius of the curved glass panels 34, preventing them from sliding into the turret. Vertical supports 30, 28 differ in structure from vertical supports 22. The vertical supports 22 support a glass panel 34 on either side. The vertical supports 28, 30 support only a single glass panel 34. The vertical supports 28, 30 are adjacent the opening in the turret portion 12 wherein the gun is located.

A plurality of clamps 24, 26, 32 are connected to the plurality of vertical supports 22, 28, 30 respectively. The clamps 24, 26, 32 are connected to the vertical supports 22, 28, 30 using, for example, threaded fasteners. The plurality of curved glass panels 34 have their ends sandwiched between the clamps 24, 26, 32 and the vertical supports 22, 28, 30. The curvature of the glass panels 34 is substantially the same as the curvature of the vehicle's turret. The clamps 24 mate with the vertical supports 22, which have glass panels 34 on either side. The clamps 26, 32 are somewhat different in structure than the clamps 24 because they mate with the vertical supports 28, 30, which support only a single glass panel 34.

Figures 3, 4, 5, 6:
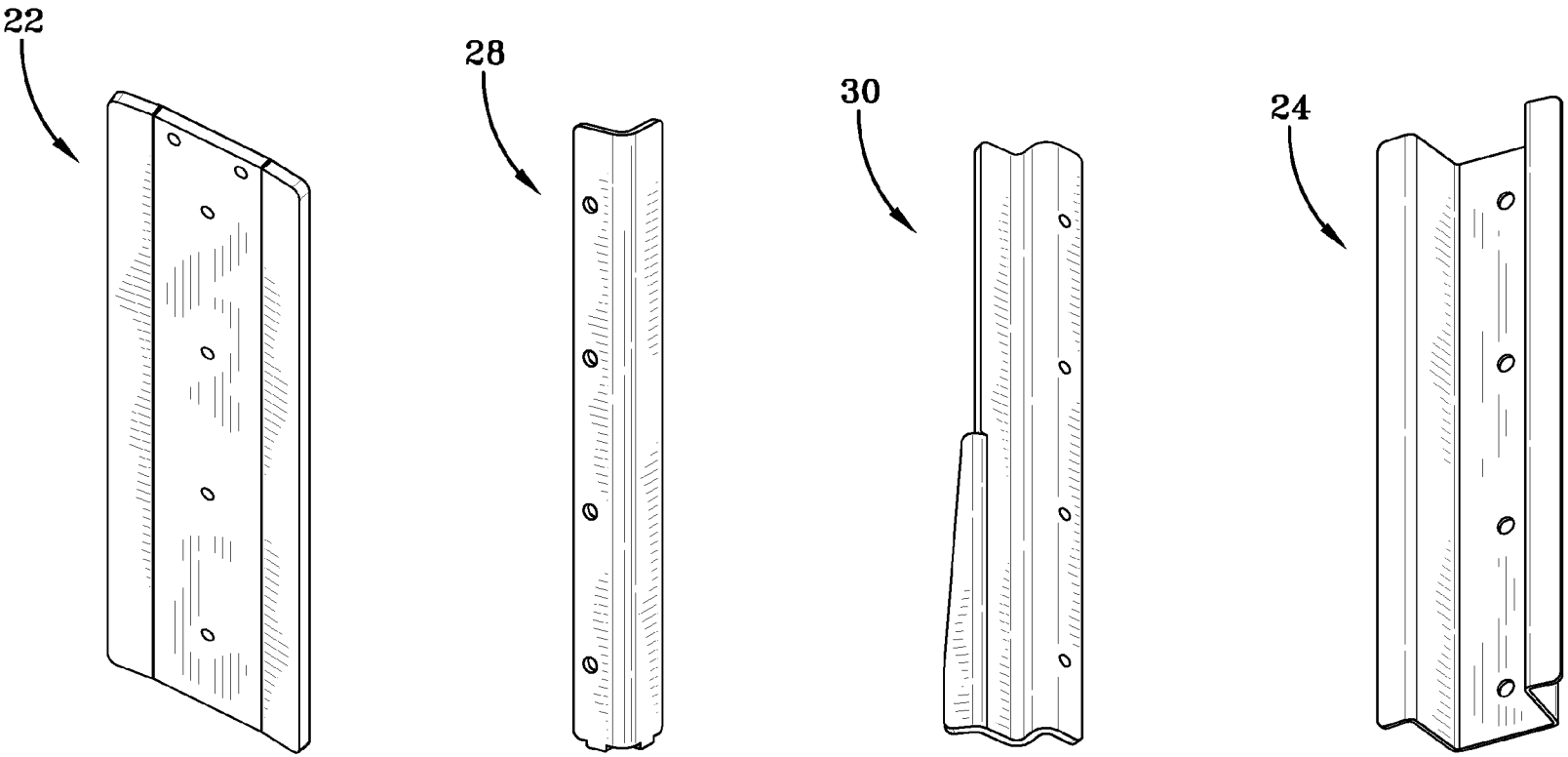
FIGS. 3-5 show vertical supports for the turret portion.
FIGS. 6-8 show clamps for the glass panels.
Figure 8:
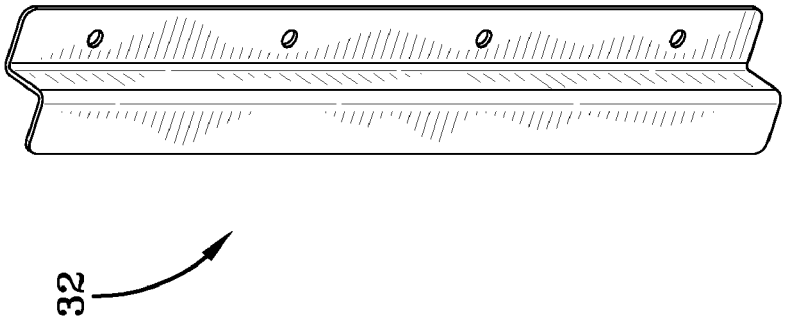
Figure 7:
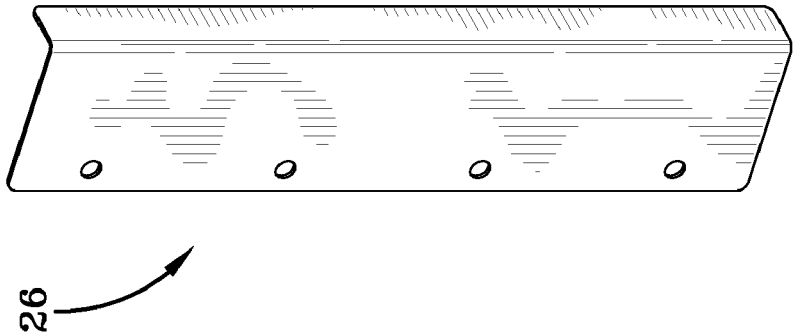

Depending on the size of the vehicle turret, the number of glass panels 34 may vary. In the disclosed embodiment, the number of glass panels is five. There are four vertical supports 22, one vertical support 28 and one vertical support 30. FIGS. 3-5 show vertical supports 22, 28 and 30, respectively. FIG. 6 shows clamp 24 used with vertical support 22. FIG. 7 shows clamp 26 used with vertical support 28. FIG. 8 shows clamp 32 used with vertical support 30. The holes in the clamps align with corresponding holes in the vertical supports and are used to fasten the clamps to the vertical supports using fasteners.

Figure 9:
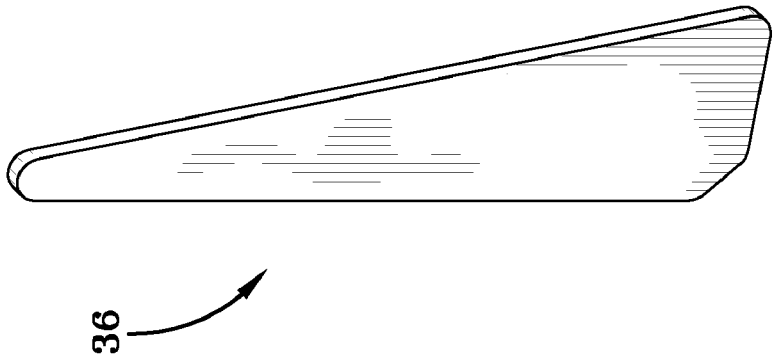
FIG. 9 shows a gusset.

Additional support for the glass panels 34 is provided by gussets 36, top rails 42 and ribs 38. FIG. 9 shows a gusset 36. Gussets 36 are generally triangular shaped plates that are fixed between the vertical supports 22, 28, 30 and the base plate 16 by, for example, welding. The gussets 36 help preventing the vertical supports from bending under the pressures of incoming projectiles and IED blasts.

Figure 10:
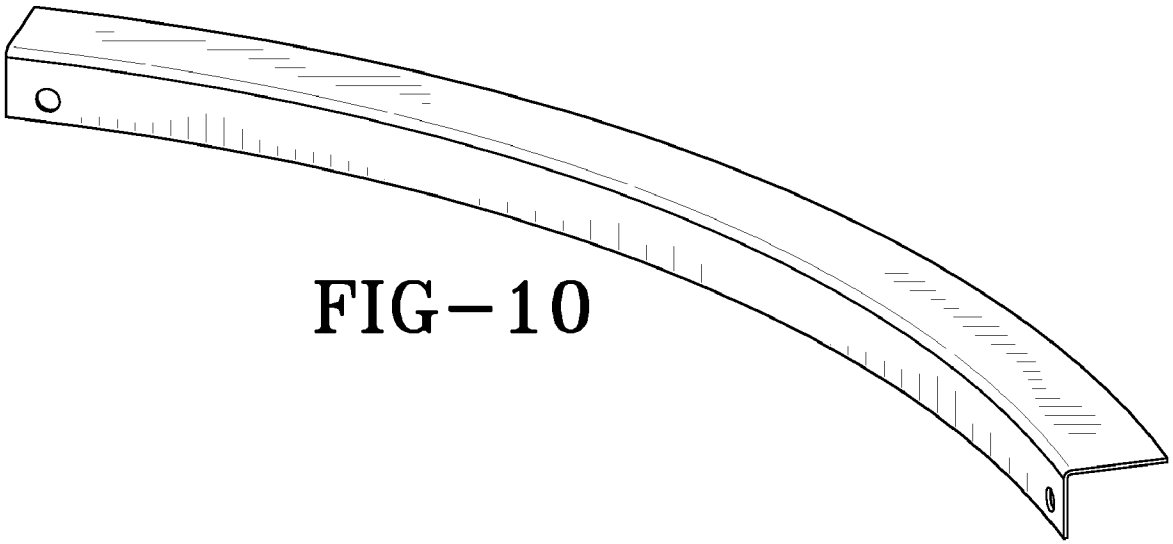
FIG. 10 shows a top rail.

FIG. 10 shows a top rail 42. Top rails 42 are curved pieces having a generally L-shaped cross-section. One angle of the L is disposed along the top edge of the glass panels 34 and the other angle of the L is disposed against the top, interior surface of the glass panels 34. The top rails 42 are fixed to the vertical supports 22, 28, 30 with, for example, threaded fasteners. The holes on the ends of the rails 42 mate with holes in the vertical supports.

Figure 11:
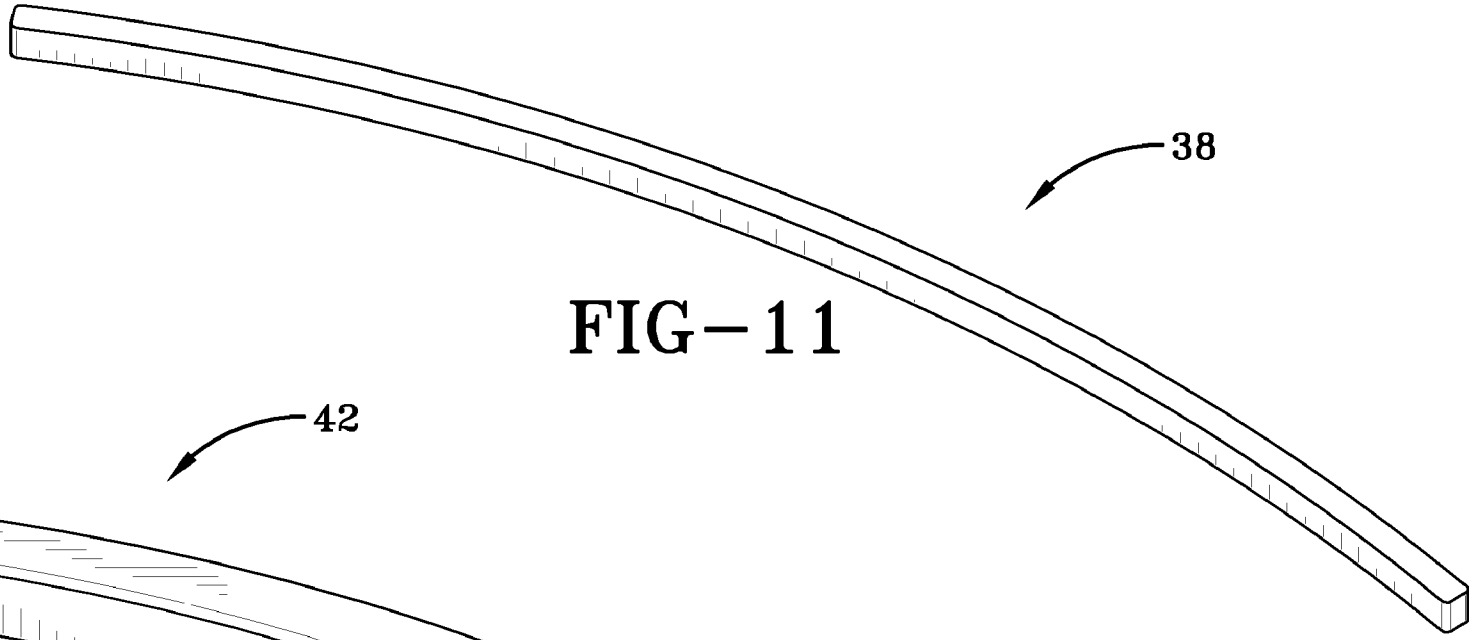
FIG. 11 shows a rib.

FIG. 11 shows a rib 38. Ribs 38 are curved pieces having a generally square cross-section. Ribs 38 are disposed on the base plate 16 and abut the lower interior surface of the glass panels 34. Ribs 38 may be attached to base plate 16 by, for example, welding.

Figure 12:
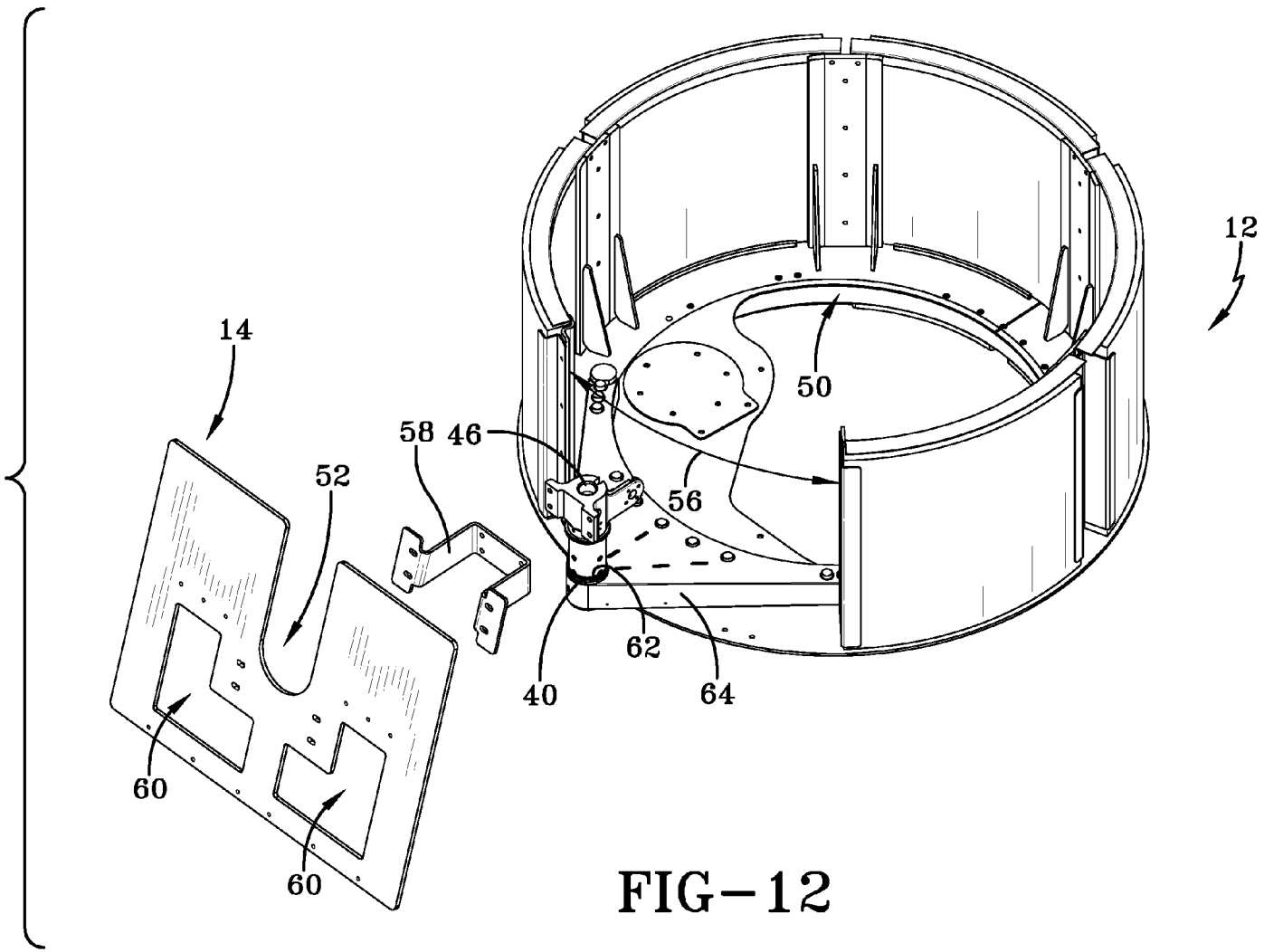
FIG. 12 shows how the front shield is fixed to the vehicle turret.
Figure 13:
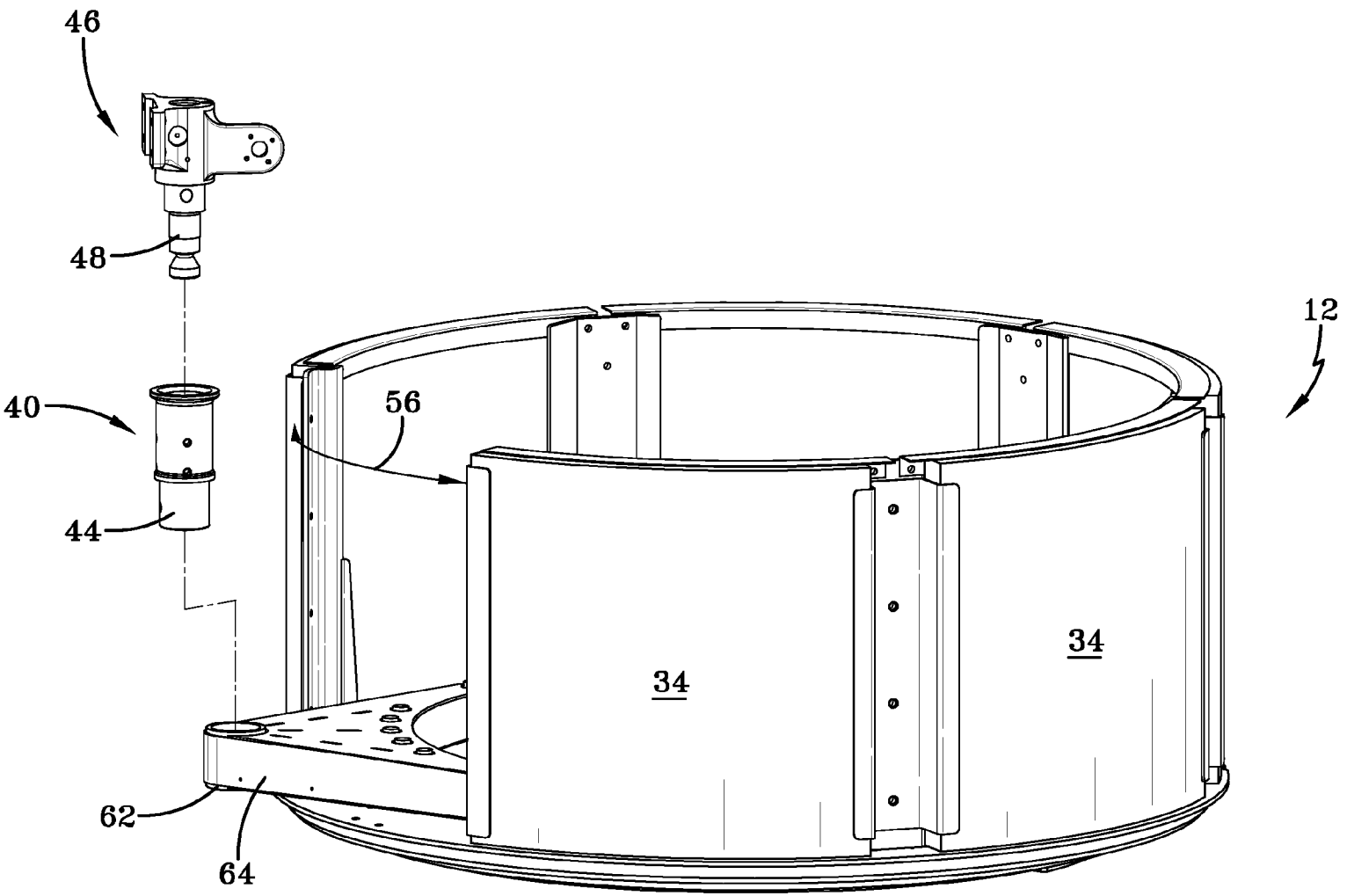
FIG. 13 shows components of the gun support.

FIG. 12 shows how the front shield 14 is fixed to the vehicle turret 50. A bat wing structure 64 is part of a conventional turret 50. Referring now to FIG. 13, bat wing 64 has a bearing sleeve hole 62 formed therein for receiving a bearing sleeve 40. Portion 44 of bearing sleeve 40 is disposed in bearing sleeve hole 62. A pintle 46 has a portion 48 that is inserted in the bearing sleeve 40. The combination of the bearing sleeve 40 and the pintle 46 comprise a gun support for holding a gun. The gun support is rotatable about a vertical axis of the bearing sleeve hole 62.

Referring now to FIG. 12, the turret portion 12 defines an opening 56 having an angular extent in the range of about 30 degrees to about 40 degrees. The opening 56 in the turret portion 12 is substantially centered around the bearing sleeve hole 62 in the turret 50 of the vehicle. A front spacer 58 is fixed to pintle 46. Front shield 14 is attached to the front spacer 58. The front shield 14 includes a gun opening 52 and at least one window opening 60. Windows 54 (FIG. 1) are mounted at window openings 60. The gun opening 52 may be generally U-shaped. The front shield 14 is rotatable with the gun support 50.

Figure 14:
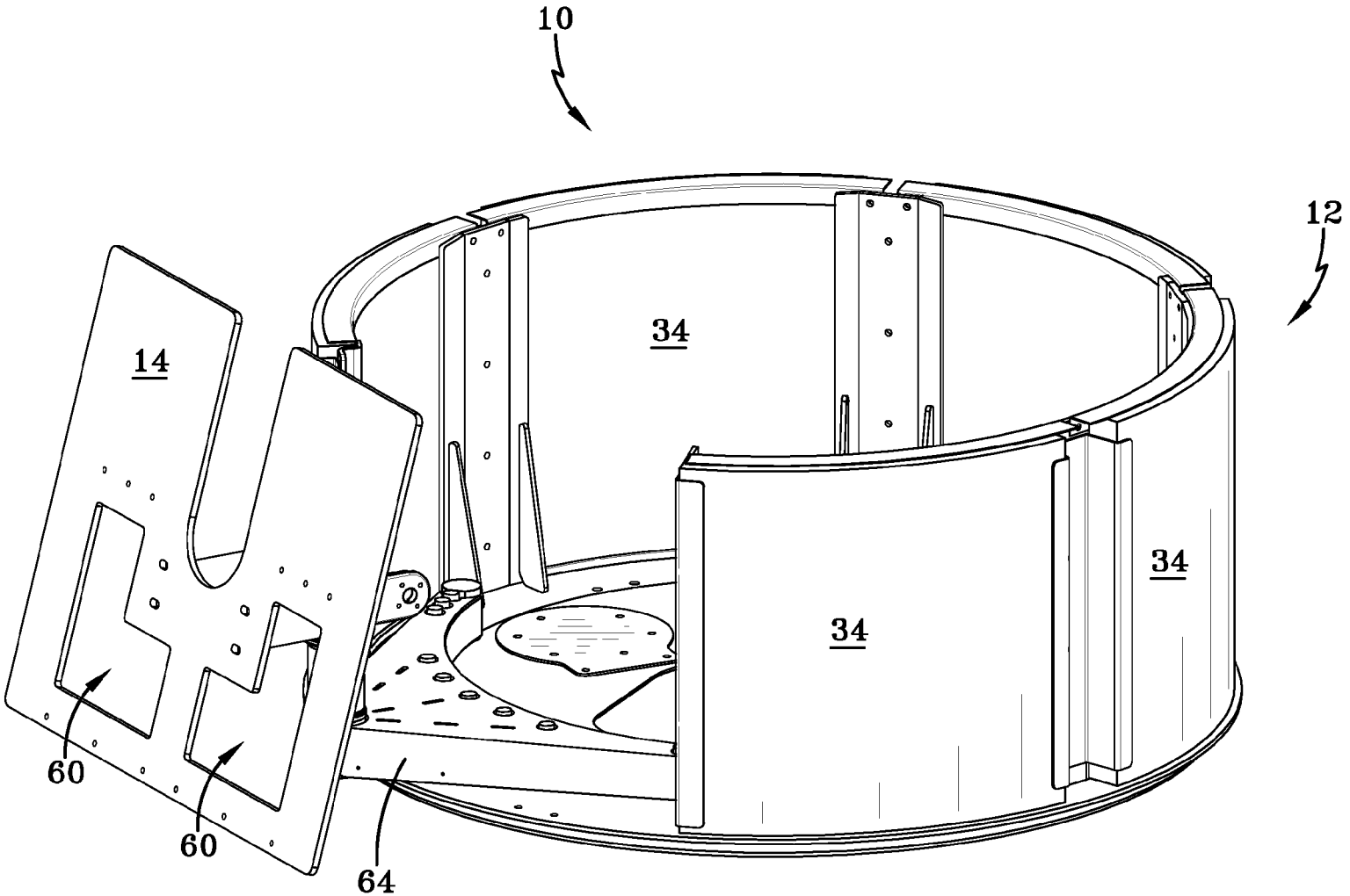
FIG. 14 shows the front shield assembled with the turret portion.

To provide protection for the gunner, the width of the front shield 14 is greater than the width of the opening 56 in the turret portion 12. Assuming that the opening 56 has an angular extent in the range of about 30 degrees to about 40 degrees, the gunner is able to rotate the gun in the range of about 15 degrees to about 20 degrees to each side, around the vertical axis of the gun support. FIG. 14 shows the front shield 14 assembled with the turret portion 12.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A gunner protection apparatus for a vehicle having a turret with a bearing sleeve hole, comprising:

a turret portion attached to the vehicle's turret, the turret portion comprising a substantially circular base plate fixed to the vehicle's turret; a plurality of vertical supports fixed to the base plate; a plurality of clamps connected to the plurality of vertical supports, respectively; and a plurality of curved glass panels having ends fixed between the clamps and the vertical supports;

a gun support disposed in the bearing sleeve hole and rotatable about a vertical axis of the bearing sleeve hole; and a front shield fixed to the gun support, the front shield having a gun opening and at least one window, the front shield being rotatable with the gun support.

2. The apparatus of claim 1 wherein the substantially circular base plate comprises two substantially semi-circular base plates.

3. The apparatus of claim 1 further comprising a plurality of gussets fixed between the vertical supports and the base plate.

4. The apparatus of claim 1 wherein the turret portion defines an opening having an angular extent in the range of about 30 degrees to about 40 degrees.

5. The apparatus of claim 1 further comprising a top rail disposed along top edges of the glass panels.

6. The apparatus of claim 5 wherein the top rail is fixed to the vertical supports.

7. The apparatus of claim 1 wherein a number of glass panels is five.

8. The apparatus of claim 1 further comprising a rib disposed along interior, bottom edges of the glass panels.

9. The apparatus of claim 8 wherein the rib is fixed to the base plate.

10. The apparatus of claim 1 wherein a curvature of the glass panels is substantially the same as a curvature of the turret.

11. The apparatus of claim 4 wherein a width of the opening in the turret portion is less than a width of the front shield.

12. The apparatus of claim 4 wherein the opening in the turret portion is substantially centered around the bearing sleeve hole.

13. The apparatus of claim 12 wherein the gun support comprises a bearing sleeve having a portion inserted in the bearing sleeve hole and a pintle having a portion inserted in the bearing sleeve.

14. The apparatus of claim 13 further comprising a front spacer fixed to the pintle, the front shield being attached to the front spacer.

15. The apparatus of claim 1 wherein the front shield includes a window on each side of the gun opening.

16. The apparatus of claim 1 wherein the gun opening is substantially U-shaped.

* * * * *